US009532614B2

(12) United States Patent
Vanneste

(10) Patent No.: US 9,532,614 B2
(45) Date of Patent: Jan. 3, 2017

(54) OVERALLS FOR CLEANROOM AND THE LIKE

(71) Applicant: Scaldis St-Martin, Peruwelz (BE)

(72) Inventor: Vincent Vanneste, Thimougies (BE)

(73) Assignee: SCALDIS ST-MARTIN, Peruwelz (BE)

( * ) Notice: Subject to any disclaimer, the term of this patent is extended or adjusted under 35 U.S.C. 154(b) by 0 days.

(21) Appl. No.: 14/106,110

(22) Filed: Dec. 13, 2013

(65) Prior Publication Data

US 2014/0101817 A1 Apr. 17, 2014

Related U.S. Application Data

(63) Continuation of application No. 12/997,538, filed as application No. PCT/EP2009/057268 on Jun. 12, 2009.

(30) Foreign Application Priority Data

Jun. 13, 2008 (BE) ..... 2008/0326

(51) Int. Cl.
*A41D 13/02* (2006.01)
*A62B 17/00* (2006.01)

(52) U.S. Cl.
CPC ..... *A41D 13/02* (2013.01); *A62B 17/006* (2013.01); *A41D 2400/44* (2013.01)

(58) Field of Classification Search
CPC ..... A41D 13/02; A62B 17/00
USPC ..... 2/69, 455, 457
See application file for complete search history.

(56) References Cited

U.S. PATENT DOCUMENTS

| | | | | |
|---|---|---|---|---|
| 3,496,572 | A * | 2/1970 | Herzig | 2/457 |
| 4,677,696 | A * | 7/1987 | Tanaka | 2/84 |
| 4,856,113 | A * | 8/1989 | Moscatelli | A62B 17/001 2/84 |
| 5,867,825 | A | 2/1999 | Scheerer | |
| 2005/0144695 | A1* | 7/2005 | Aldridge et al. | 2/69 |
| 2006/0277667 | A1 | 12/2006 | Plut | |
| 2007/0192947 | A1* | 8/2007 | Plut et al. | 2/457 |

FOREIGN PATENT DOCUMENTS

| | | |
|---|---|---|
| CH | 505576 | 4/1971 |
| EP | 0242440 | 10/1987 |
| FR | 2810855 | 1/2002 |
| JP | 200373912 | 3/2003 |
| WO | 2004105524 | 12/2004 |

* cited by examiner

*Primary Examiner* — Katherine Moran
(74) *Attorney, Agent, or Firm* — Koppel, Patrick, Heybl & Philpott

(57) ABSTRACT

A clean room suit including at least one first grasping means on an inner face for facilitating dressing.

11 Claims, 4 Drawing Sheets

OVERALLS FOR CLEANROOM AND THE LIKE

CROSS-REFERENCE TO RELATED APPLICATIONS

The present application is a continuation of U.S. patent application Ser. No. 12/997,538, filed Dec. 10, 2010, which is the National Phase of International Application No. PCT/EP2009/057268, filed Jun. 12, 2009, and claims the benefit of Belgian Patent Application No. BE 2008/0326, filed Jun. 13, 2008. All of the above listed applications are hereby incorporated by reference herein in their entireties.

BACKGROUND

The present invention relates to a suit for a clean room comprising an outer face provided for being in contact with a surrounding medium and an inner face arranged to be in contact with a user, a first and a second leg section connected to each other through an opening in a crotch area, a first and a second sleeve and a body portion to which are connected the first and second sleeves through a bound end and the first and second leg sections also through a bound end, said body portion comprising a section for letting through the head.

Such suits are used in environments of clean rooms, in laboratories which for example allow the making of drugs in an aseptic and sterile environment. In this type of room, the body of the user has to be isolated so that he/she does not contaminate the environment in which he/she works or the product which he/she makes.

When an operator has to work in a sterile environment, he/she should, prior to his/her entering the clean rooms, wear suits while observing a very particular protocol. Such procedures are very tedious and generally impose that the user dress in a completely contrary way to what he/she is used to do and unlike how one would dress instinctively.

Existing suits are therefore sterilized and provided in sealed packages which should be easy to open for the operator, before entering the clean room, but sufficiently resistant in order to avoid the tearing which may be the consequence of the contact with a contaminated environment.

The operator then has to slip on the suits without touching the outer face intended to be in contact with the sterile environment and especially without touching the outer face of the body portion (covering the thorax). Therefore a whole handling operation ensues during which certain portions of the suit are folded back, where the user climbs onto a bench, slips in one leg without it touching the ground, and then the other, while being careful not to let go or touch anything, which requires exercise necessitating exceptional dexterity and long years of practice. Consequently, there often results a little handling error or unbalance which requires changing suit. Of course, such sterilely provided suits individually packaged beforehand, are expensive and represent a relatively high operating cost for the company requiring such suits.

Many developments have been achieved with the purpose of simplifying the step for dressing the operator who has to sometimes enter a clean room several times a day.

For example, from document FR 2 810 855, a suit as mentioned initially is known which has a hooking member with which said concertina-folded suit may be hoisted up to a bracket so that it may be slipped onto the user from top to bottom when it is lowered down again.

Of course, this type of suit is simpler to wear than conventional suits. Unfortunately, it requires a device with which the suit may be hung and a certain volume space for lifting the suit and lowering it down again.

Of course, since the environment of clean rooms is aseptic and sterilized, it is clear that the requirement of such a large volume space represents a considerable maintenance cost (about twice the height of a normal room). Further the suit according to document FR 2 810 855 requires a dressing procedure starting with how to hang the suit from the bracket before slipping it on without touching the outside and ending with the slipping on per se. Consequently, untimely exercise is avoided, but it is clear that the dressing procedure is not particularly simplified.

From document CH 505576, a protective overall is known comprising a body and a skirt as well as a hood for cooperating with a face mask.

The overall therefore does not comprise any first and second leg sections and is made in impervious material.

This overall comprises flaps which are essential for folding and when it is sterilized, i.a. requires help from an assistant for slipping it on since each sleeve is folded on itself until the closest half of its end forming a sleeve surrounds the other half of the sleeve.

Therefore, there is always a need for a clean room suit which is slipped on in a particularly easy way without any bracket and without any assistance, while drastically simplifying the dressing procedures and which implies a very instinctive way for putting on the suit in order to avoid costly errors. Indeed, when an error occurs, i.e. the operator realizes this and changes suit. In this case, only the waste of time and the suit represent the generated overcost. On the other hand if the operator does not realize his/her error and contaminates a whole batch of vaccines, the loss is then much greater.

The object of the invention is to overcome the drawbacks of the state of the art by providing a suit with which the dressing steps and procedures may be simplified to a maximum and for which the dressing steps are particularly instinctive in order to avoid handling errors.

In order to solve this problem, a suit as indicated initially is provided according to the invention, characterized in that it further comprises a first grasping means, in contact with the inner face in the body portion, and preferably in the waist section.

In this way, since the grasping means is in contact with the inner face of the suit, in the body portion, when the operator grasps the suit with said grasping means, the latter is found in a particularly advantageous position for simplifying dressing. Indeed, when the grasping means is grasped by the operator, the inner face of the first and second leg section are facing the outer face of the body portion of said suit.

The interior portion of the body portion is therefore accessible to the user who, though still having the grasping means at hand, may then easily slip his/her free arm into the first sleeve, he/she then lets go the grasping means and slips his/her arm into said second sleeve. He/she then turns over the suit on his/her head by slipping the body portion in this way on his/her thorax and passes his/her head through the head section. The first and second leg section are then automatically unfolded along the legs of the user and the suit is thus put on without its outer face having been in contact with a body portion.

As this may be easily seen, such a suit is slipped on in the same way as a pullover is slipped on every morning when one dresses. This therefore represents a particularly instinctive dressing procedure for the operator.

In a particularly advantageous embodiment, the suit according to the invention further comprises a second grasping means, in contact with the inner face, in the body portion, preferably at the waist section. In this way, the operator may grasp with a first hand a first grasping means and with a second-hand a second grasping means, which promotes proper grasping of the suit and avoids dropping it during dressing.

Advantageously, the first and second grasping means are located sideways on either side of said opening in the body portion more preferentially at the waist section. In this way, the first grasping means located sideways on one side of said opening may be grasped with the left hand or with the right hand while the second grasping means located sideways on the other side of said opening in the body portion may be grasped with the right hand or the left hand respectively. This means that when both grasping means are grasped by the operator, the suit according to the invention is located in the proper alignment with respect to the way of slipping it on. That is to say that the suit faces the body of the operator.

As used herein, the "first grasping means" and the "second grasping means" can comprise, for example, respective loops.

In a particular embodiment of the invention, the first grasping means is differentiated from the second by a difference in texture, colour, shape, relief or the like. In this way, the user knows with which hand he/she has to grasp the first grasping means and with which hand he/she has to grasp the second grasping means. Consequently, as the suit is already in the proper alignment, it is now certainly also in the dressing direction, i.e. when the user slips on the suit, a back section of the body portion of the suit will be at the level of the back of the operator while the front section of the body portion of the suit will be on the thorax of the operator.

In a particular embodiment according to the invention, said opening is equipped with one or more closure means selected from a zipper, a self-adhering means, press studs or the like as well as optionally a placket, with which contamination of the sterile environment by bodily portions may be avoided.

Advantageously, the suit according to the invention further comprises an optionally removable balaclava connected to the body portion at the head section. In this way, when this is necessary and this is often the case in such clean rooms, it is no longer necessary to wear paper headwear for covering the hair of the operator, the suit according to the invention already comprises a balaclava integrated to the suit.

In an advantageous embodiment of the suit according to the invention, the first and/or the second sleeve include self-tightening means at a free end, opposite to the bound end such as cuffs in elastic fabric, a flap with press stud or self-adhering means and the like. Indeed if the opening of the sleeves is too wide, the outer environments may be contaminated with the skin of the arms.

Further, the first and/or the second leg section include self-tightening means at a free end, opposite to the bound end, such as elastic fabric ankle bands, a flap with press stud or self-adhering means and the like. This provides the same advantage as the self-tightening means of the sleeves and avoids contamination of the external medium by the legs of the operator.

In an advantageous embodiment, said opening at the crotch of the suit according to the invention has a zipper, a male end of which is engaged and pre-assembled in the female cursor in a non-separable way. In this way, the movement of the zipper slider is simplified and the operator does not have to engage the lugs himself/herself since this represents a tedious and difficult dressing step, especially when the hands are fitted out with gloves.

In a particular embodiment of the invention, the clean room suit further comprises a first and/or a second glove respectively connected to the free end of the first and/or the second sleeve. In this case, it is not absolutely necessary to add a pair of gloves, the suit according to the invention already comprising its own gloves connected to the sleeves.

Advantageously, the suit according to the invention in the folded-back position has: the inner faces of the first and second leg sections exposed towards the outside and the outer face of the first and second leg sections exposed towards the outer face of the body section, said opening of the crotch being then laid out in order to give access to the inside of the body portion and said grasping means being exposed towards the operator. In this way, with the outer faces of the first and second leg sections which are exposed towards the outer face of the body section, the outer face of the whole suit may be protected from accidental contact during dressing since the outer faces of all the portions of the suit are facing each other.

Further, since said grasping means are exposed towards the operator, grasping the suit is particularly easy.

Preferably, the suit according to the invention in the folded-back position has first and second leg sections folded back longitudinally on themselves and transversely on themselves in several (two, three, four, . . . ) portions. In this way, the suit is shown in a folded-back way to the user, sterilized beforehand so that it is compact and may easily be grasped by the operator.

Other embodiments of the suit according to the invention are indicated in the appended claims.

The object of the invention is also a method for folding a clean room suit according to the invention comprising the steps of:

- exposing at least one first grasping means towards the outside by grasping the latter,
- folding back an outer face of a first and second leg section by passing of a crotch section in the open position on an outer face of a body portion while maintaining said first grasping means exposed,
- folding a side portion of a first leg section on itself and a side portion of a second leg section on itself, in a longitudinal direction of the first and second leg sections while maintaining said first grasping means exposed, and
- folding by folding back in several portions the thereby longitudinally folded leg sections in a transverse direction of the first and second leg sections, while maintaining said first grasping means exposed.

Advantageously, the folding method according to the invention further comprises exposing a second grasping means towards the outside by grasping the latter.

Other embodiments of the folding method according to the invention are mentioned in the appended claims. The invention also relates to a dressing method for putting on a clean room suit comprising the steps of:

- grasping a first grasping means with a first hand of a operator in order to position the suit so that the body portion of the suit is accessible via the opening of the crotch of the suit,
- slipping a second arm of the operator into a second sleeve and, after having let go of the first grasping means, slipping a first arm of the operator into a first sleeve, passing the head of the operator into an opening of the body portion and then into the section for letting through the head, and turning over the leg sections so that the outer face of the latter is then exposed towards the outside and the outer face exposed towards the legs of the operator.

In a preferential embodiment, the dressing method further comprises grasping of a second grasping means with a second hand of the operator in order to position the suit so that the body portion of the suit is accessible via the opening of the crotch of the suit. Preferably the dressing method for putting on the suit according to the invention also comprises closing of said opening.

Other embodiments of the dressing method according to the invention are indicated in the appended claims.

Other details, features and advantages of the invention will become apparent from the description given hereafter not as a limitation and with reference to the appended drawings.

In the figures, identical or analogous elements bear the same references.

Figure 1:
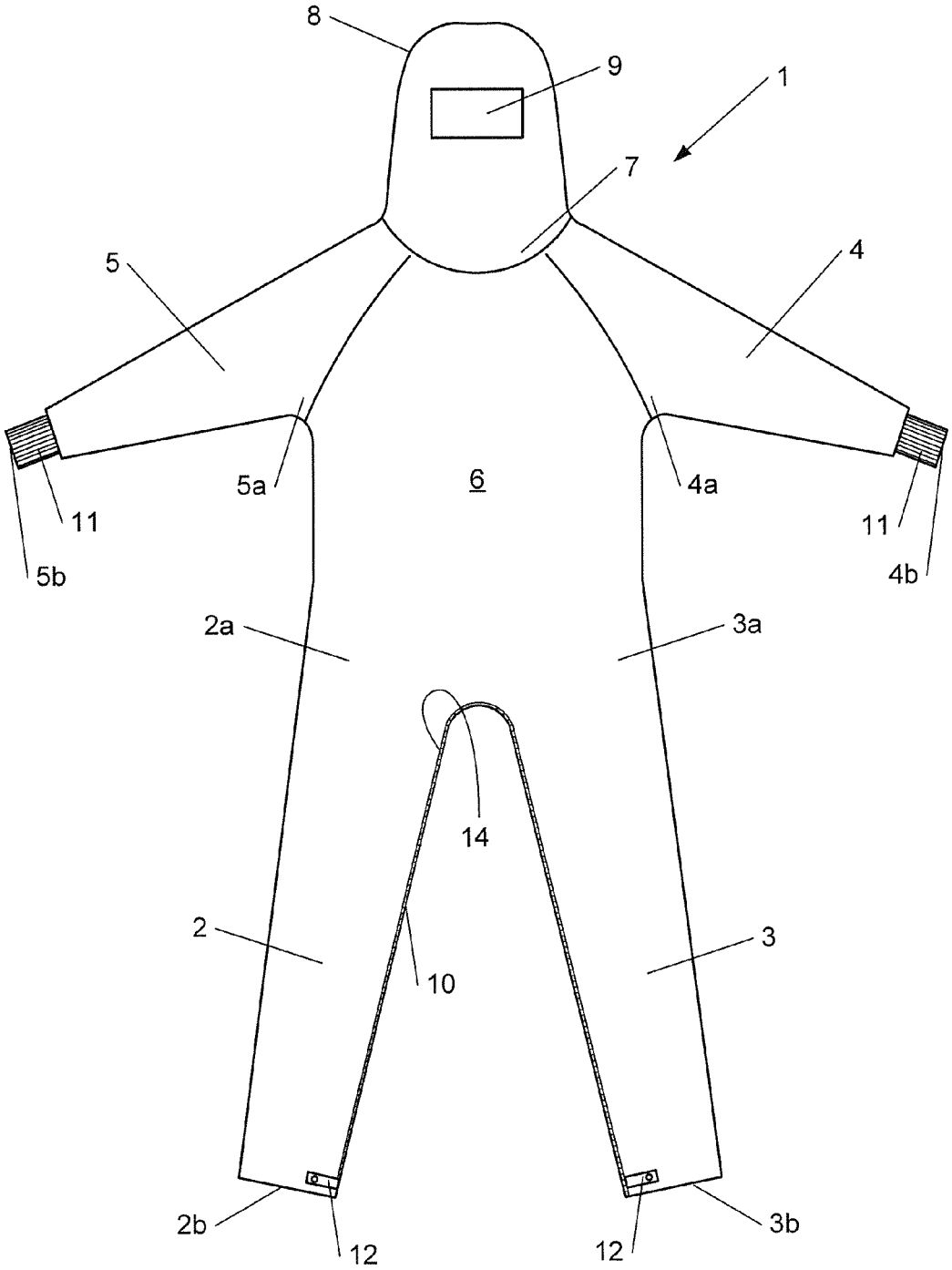
FIG. 1 is a front view of a suit according to the invention.

FIG. 1 illustrates a clean room suit comprising an outer face provided for being in contact with a surrounding medium and an inner face laid out so as to be in contact with a user or operator. The suit comprises a first leg section 2 and a second leg section 3 connected to each other through an opening in the crotch area 14, it also comprises a first sleeve 4 and a second sleeve 5 and a body portion 6. The first sleeve is connected through a bound end 4*a* and the second sleeve is connected through a bound end 5*a*. The first leg section 2 also comprises a bound end 2*a* and the second leg section 3 also comprises a bound end 3*a*. The suit also comprises a section 7 for letting through the head.

In an alternative as the one illustrated here, the suit according to the invention comprises a balaclava 8 provided with an opening for the eyes 9. As this may be seen, said opening of the crotch area 14 is equipped with a zipper 10 and it comprises a placket (not shown) located below the zipper in order to avoid any contamination through said zipper. Of course, the opening may be closed by other equivalent means such as self-adhering means (Velcro), snap fasteners or the like. Also the balaclava 8 connected to the body portion at the section 7 for letting through the head may also be removable and consequently connected i.e. through a zipper, self-adhering means, snap fasteners or the like.

In an advantageous embodiment, the first sleeve 4 comprises self-tightening means at the free end 4*b* in the form of cuffs 11 in elastic fabric. The second sleeve also comprises at the free end 5*b* a cuff 11 in elastic fabric. The elastic fabric cuffs may also be replaced with a flap with press stud or self-adhering means or further other conventional means. The first leg section 2 comprises a flap 12 with a press stud allowing the free end 2*b* of the leg section to be tightened. The second leg sections 3 also comprises a flap with press stud 12 with which the diameter of the leg section at the free end 3*b* may be adjusted.

In the illustrated alternative, the end of the zipper 10 is engaged and pre-assembled beforehand so as to simplify the slipping-on of the suit according to the invention.

Figure 2:
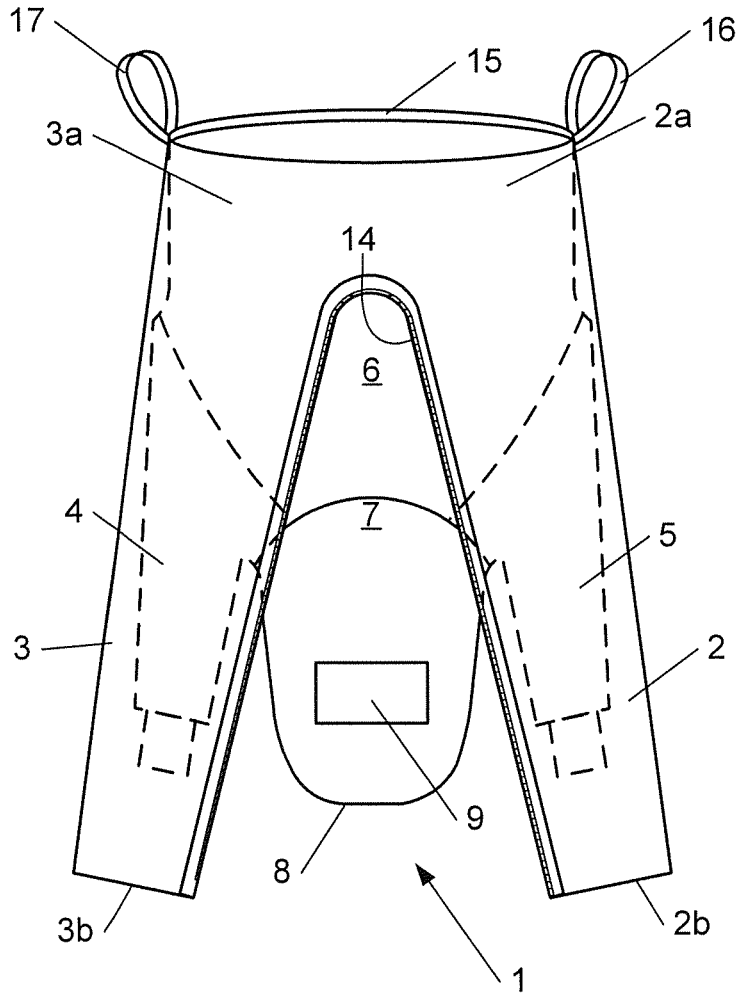
FIG. 2 is a top view of a suit according to the invention in the partly folded-back position.

FIG. 2 illustrates the suit in the partly folded-back position. The inner face of the first leg section 2 and of the second leg section 3 are exposed towards the outside. The outer face of the first leg section 2 and the outer face of the second leg section 3 are exposed towards the outer face of the body section 6. Said opening of the crotch 14 provides access to the inside of the body portion 6 through a section called a waist section 15. In this way, the first grasping means 16 and the second grasping means 17 are exposed towards the operator. Indeed the latter are present on the inner face of the suit and by partly turning over the leg sections on the body section, it is possible to expose them towards the outside. When an operator has put on a suit according to the invention in order to carry out his/her work in the clean room, once the work is completed, he/she will have to remove the suit. The latter will then have to be washed and sterilized with a view to subsequent use. Such steps are either generally subcontracted by external corporations who bring back the folded and packaged suits in sterile packages. On other industrial sites, the suits are folded and washed on site as well as reconditioned in an aseptic individual package. Consequently, in order to ensure that the suit according to the invention is put on easily, it is advantageous to observe the steps of a folding method according to the invention as mentioned here, the first step of which will be the one illustrated in FIG. 2.

During this step, the first 16 and the second grasping means 17 are exposed towards the outside when the packer grasps them and he/she folds back the outer face of a first 2 and of a second leg section 3 by passing a crotch section 14 open on an outer face of a body portion 6 while maintaining the first 16 and the second grasping means 17 exposed.

Figure 3:
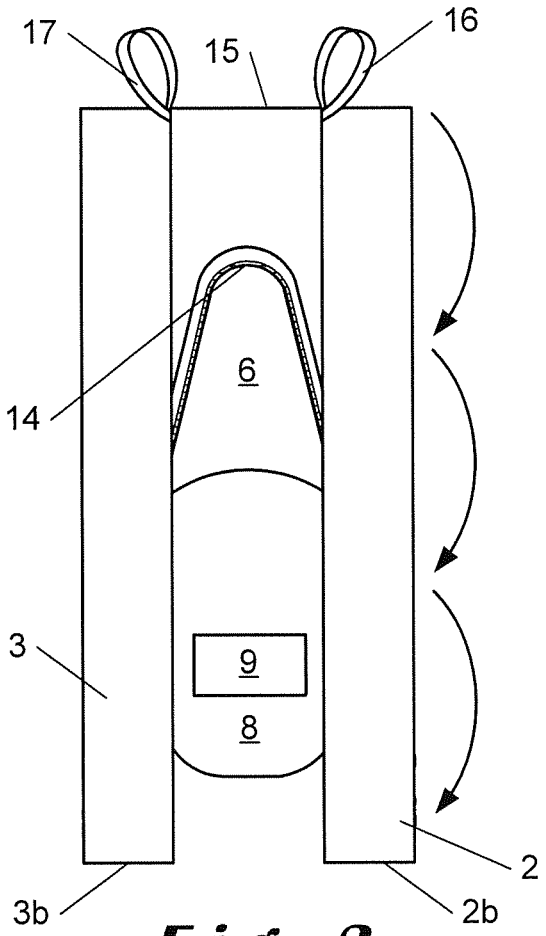
FIG. 3 is a top view of the suit in the partly folded-back position, in which longitudinal folding-back has taken place.

The second step of the folding method is the one illustrated in FIG. 3. In this step, the first leg section 2 is longitudinally folded back on itself and the second leg section 3 is also longitudinally folded back on itself while leaving the first and second grasping means (16 and 17) exposed towards the operator. Further, the last step for folding the suit according to the invention is illustrated by arrows in FIG. 3. Indeed, the thereby folded suit 1 according to the invention will then be folded back transversely on itself into all three portions or even more, if this is necessary, depending on the size of the suit. The thereby folded suit 1 is then conditioned in a casing 18 and sterilized, for example in an autoclave.

Figure 4:
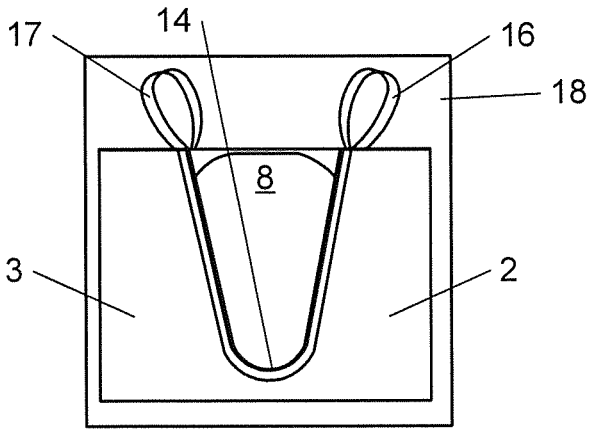
FIG. 4 is a top view of an embodiment of the suit according to the invention in the folded back and packaged position.

When a user intends to put on a suit 1 according to the invention, he/she opens the package 18 illustrated in FIG. 4 for example by peeling the upper face, grasps the first grasping means 16 with a first hand and the second grasping means 17 with the second hand and lifts the suit 1. In this way, he/she obtains a suit 1 in the partly folded-back position, as illustrated in FIG. 2. The suit 1 is positioned so that the body portion is accessible via the opening of the crotch 14 of the suit via waist flexing 15. But the operator after having let go of the second grasping means 17, then slips his/her second arm into a second sleeve 5 and, after having let go of the first grasping means 16, he/she slips the first arm into the first sleeve 4. He/she then passes his/her head into an opening of the body portion 6 via the waist section 15 and then into the section 7 for letting through the head before ending up in the balaclava 8. He/she then turns over the leg sections 2, 3 so that the outer face of the first leg section 2 and of the second leg section 3 are exposed towards the outside and so that the inner face of the first leg section 2 and of the second leg section 3 are exposed towards the legs of the operator. Next, the operator positions his/her foot in the foot passage section 3*b* which includes the pre-engaged zipper and closes said opening 14 for completely isolating his/her body from the outside environment.

As this has already been mentioned hereinbefore, the slipping-on of the suit according to the invention is a particularly instinctive slipping-on.

Figure 5:
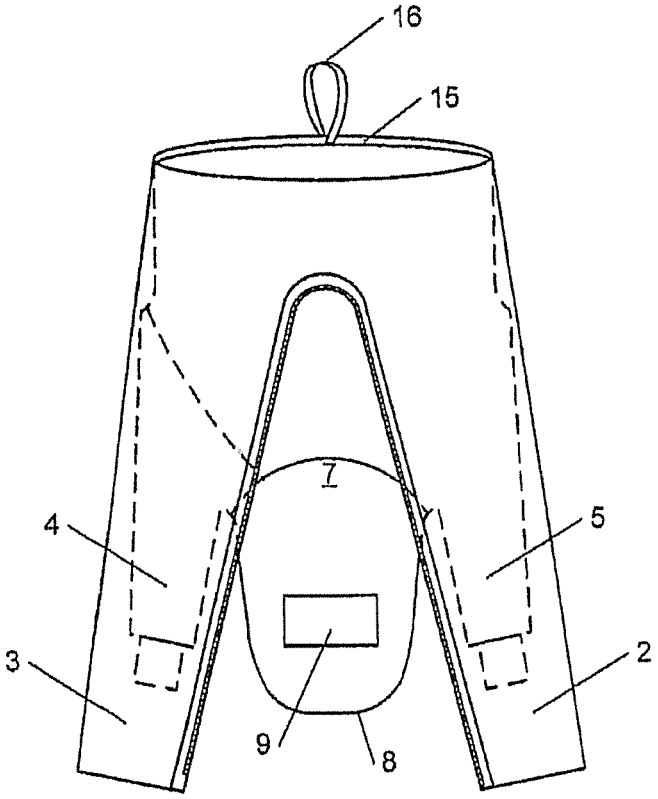
FIG. 5 is a top view of an alternative of a suit according to the invention in the partly folded-back position.

FIG. 5 illustrates an alternative of the invention wherein a single grasping means 16 is present, in this way the operator grasps the first grasping means 16 with a first-hand, he/she slips his/her second arm into said second sleeve 5 and, after having let go of the first grasping means 16, he/she slips the first arm into the first sleeve 4. The user then slips his/her head into an opening of the body portion 6 via the waist section 15 and then into the section 7 for letting through the head so it ends up in the optional balaclava 8, if it is present. By straightening out, the leg sections 2 and 3 automatically turn over on the legs of the operator and the latter just has to close the zipper.

Of course the present invention is by no means limited to the embodiments described above and many modifications may be made thereto without departing from the scope of the appended claims.

For example, the suit according to the invention may also be used in sterile rooms in hospitals so as to avoid contaminating the patients, the immune defences of whom are weakened. Further, it is clear that the suit according to the invention may also be used for protecting the wearer from the outside medium, for example for those looking after highly contagious patients.

Further, means may be provided such as an elastic, a pocket, a slit or the like allowing a finger to be engaged therein, located on the inner surface of said free end of the first or second leg section which includes the pre-engaged zipper. In this way, closing the opening 14 of the crotch is simplified since these means in which a finger is engaged prevent the free end of the leg section from moving up when the cursor of the closure is moved upwards.

In an alternative, an elastic laid out so as to pass under the foot may also be provided, which would be connected at two points to the free end of the leg section. This elastic would also have a role of avoiding that the free end moves upwards when the cursor of the zipper is pulled.

I claim:

1. A suit comprising:

a first and a second leg section connected to each other through an opening in a crotch area, a first and a second sleeve, and a body portion to which are connected the first and second sleeves through a bound end and the first and second leg sections also through a bound end, said body portion comprising a section for letting through the head, wherein said suit is a clean room suit, the exterior surfaces of said leg sections, said sleeves, and said body portion being an outer face which is in contact with a surrounding medium when said suit is worn, the opposite side of the material which forms said outer face being an inner face which is in contact with an operator when said suit it worn, the suit further comprising a first loop for donning the suit, said first loop being present on the inner face of the suit in the body portion such that the first loop is to be in contact with the operator.

2. The suit according to claim 1, further comprising a second loop, in contact with the inner face, in the body portion.

3. The suit according to claim 2, wherein the first loop and the second loop are located sideways, on either side of said section for letting through the head.

4. The suit according to claim 2, wherein the first loop is differentiated from the second loop by a difference in at least one of texture, color, shape, and relief.

5. The suit according to claim 1, wherein said opening is equipped with one or more closures selected from a zipper, a self-adhering fastener, snap fasteners, or a placket.

6. The suit according to claim 1, further comprising a balaclava connected to the body portion at said section for letting through the head, which is optionally removable.

7. The suit according to claim 1, wherein the first and/or the second sleeve include a self-tightener at a free end, opposite to the bound end.

8. The suit according to claim 1, wherein the first and the second leg sections include a self-tightener at a free end, opposite to the bound end.

9. The suit according to claim 1, wherein said opening at the crotch has a zipper, a male end of which is engaged into a female cursor in a non-separable way.

10. The suit according to claim 1, having, in a folded-back position:

the inner face of the suit in the first and the second leg sections exposed toward the outside and the outer face of the suit in the first and second leg sections exposed towards the outer face of the body section;

said opening of the crotch then laid out so as to give access to the inside of the body portion; and said loop exposed towards the operator.

11. The suit according to claim 10, having in the folded-back position, first and second leg sections longitudinally folded-back on themselves and transversally on themselves in two or three portions.

* * * * *